US007337929B2

(12) United States Patent
Winckels

(10) Patent No.: US 7,337,929 B2
(45) Date of Patent: Mar. 4, 2008

(54) DEVICE WITH DUAL DISPENSING SYSTEM

(75) Inventor: Mathilde Winckels, Clichy (FR)

(73) Assignee: L'Oreal, Paris (FR)

( * ) Notice: Subject to any disclaimer, the term of this patent is extended or adjusted under 35 U.S.C. 154(b) by 477 days.

(21) Appl. No.: 10/895,069

(22) Filed: Jul. 21, 2004

(65) Prior Publication Data

US 2005/0045668 A1 Mar. 3, 2005

Related U.S. Application Data

(60) Provisional application No. 60/499,358, filed on Sep. 3, 2003.

(30) Foreign Application Priority Data

Jul. 21, 2003 (FR) ..... 03 08894

(51) Int. Cl.
*B65D 47/00* (2006.01)
*B65D 51/16* (2006.01)
*B67D 3/00* (2006.01)

(52) U.S. Cl. ..... 222/548; 222/549; 222/552; 220/366.1; 220/661; 220/288; 215/44; 215/380

(58) Field of Classification Search ..... 222/519, 222/548, 549, 552, 551; 220/366.1, 661, 220/676, 231, 288; 215/44, 380, 385
See application file for complete search history.

(56) References Cited

U.S. PATENT DOCUMENTS

| | | | | |
|---|---|---|---|---|
| 1,775,959 A | | 9/1930 | Himes | |
| 1,880,022 A | * | 9/1932 | Monarch | 222/551 |
| 1,996,284 A | * | 4/1935 | Dunning | 222/519 |
| 2,008,319 A | | 7/1935 | Bruns et al. | |
| 2,721,004 A | | 10/1955 | Schultz | |
| 2,729,361 A | | 1/1956 | Ephron | |
| 2,791,358 A | | 5/1957 | Gaertner | |
| 3,283,964 A | | 11/1966 | Anderson | |
| 2003/0062329 A1 | * | 4/2003 | Alley | 215/307 |

FOREIGN PATENT DOCUMENTS

| | | |
|---|---|---|
| FR | 2829999 | 3/2003 |
| GB | 501220 | 2/1939 |

* cited by examiner

*Primary Examiner*—Kevin Shaver
*Assistant Examiner*—Stephanie E. Tyler
(74) *Attorney, Agent, or Firm*—Oblon, Spivak, McClelland, Maier & Neustadt, P.C.

(57) ABSTRACT

A device for packaging and dispensing a product, in particular a cosmetic product, which includes a container holding the product. The container is surmounted by a neck, such that a free edge of the neck delineates a first dispensing aperture for the product. A detachable lid is capable of engaging with the neck to selectively close off the first dispensing aperture. In an illustrated example, the free edge of the neck at least partially delineates a second dispensing aperture, with the second dispensing aperture capable of passing from a closed off position to an open position in response to a movement of the lid relative to the neck, so that (i) in a first dispensing mode, the lid is in an intermediate position relative to the neck between a closed-off position of the first aperture and a detached position from the neck, and the product is dispensed via the second aperture, and (ii) in a second dispensing mode, the lid is detached from the neck, and the product is dispensed via the first aperture.

67 Claims, 2 Drawing Sheets

-1-

-1-

DEVICE WITH DUAL DISPENSING SYSTEM

CROSS REFERENCE TO RELATED APPLICATIONS

This document claims priority to French Application Number 03 08894, filed Jul. 21, 2003 and U.S. Provisional Application No. 60/499,358, filed Sep. 3, 2003, the entire contents of which are hereby incorporated by reference.

FIELD OF THE INVENTION

The invention relates to a pot which can be used for the packaging of cosmetic products. The invention is particularly advantageous for use in packaging of products in the form of a gel or a cream. The invention aims in particular to facilitate the dispensing of the contents of such pots.

BACKGROUND OF THE INVENTION

Discussion of Background

Typically, in the field of cosmetics, the contents of the pot or jar are taken up using one or more fingers which the user inserts into the pot. In particular, where the pots have a small cross-section relative to their height, the removal of the product is not easy. In addition, when the pot is nearly used up, even if its height is small relative to its cross-section, as the user inserts her fingers into the product in order to remove the remaining product, her fingers can become covered with product on the two inside and outside surfaces of the hand, and even under the nails. The user prefers to exclusively use the inside surface of her fingers to apply a product, particularly when it is to be applied to the face.

Moreover, in the case where the user successively applies different types of products, the user is obliged to wash her hands between each application, or run the risk of contaminating the pot with constituents originating from other products previously applied and remaining as residue on her fingers. This contamination poses a problem in that it is liable to more rapidly alter the nature of the formulation contained in the pot, for example, causing the product to lose its properties.

In the same way, contamination may originate from external sources related to the conditions of use of the product. For example, when the product is used in the shower, there is a risk that the water sprayed into the shower cubicle will enter the pot. By thus modifying the cosmetic composition of the product contained in the pot, this contamination can also cause the product to lose its cosmetic properties.

A container is known from the teachings of FR 2,829,999 and U.S. Pat. No. 2,791,358, that avoids contamination problems and which has a single dispensing aperture with a small cross-section, from which the product is able to flow by gravity when the container is oriented in an "upside down" position. In this position, the user can then take up the product released from the outer rim of the aperture. To this end, this receptacle includes two openings of substantially identical cross-section formed in a wall of the receptacle, with a first opening forming the dispensing aperture, and a second opening cooperating with means of attachment of a capsule capable of selectively closing off this dispensing aperture. The capsule is not designed to be detachable from this second opening. This dispensing method is inflexible and does not facilitate optimal discharge of the product from such receptacles, especially for products of relatively thick consistency with a limited flow coefficient.

U.S. Pat. No. 3,283,964 describes a known container having two openings of dissimilar cross-section. The first opening forms a filling aperture while the second opening forms a dispensing aperture. In this arrangement, the container includes two juxtaposed necks, each respectively delineating an opening. The container is fitted with a means of closure having a first part screwed onto the second opening, with this first part being connected by a hinge to a second part capable of selectively closing off the first opening. This closure arrangement is difficult to manipulate in order to open the two apertures. In effect, it is necessary to rotate the second part about a hinge to open the first aperture, then to unscrew the first part to open the second aperture. This closure arrangement cannot be operated by a simple movement. Furthermore, none of the defined apertures can be used to remove the product directly from the inside of the container.

Alternatively, toothpaste tubes are known that are made with flexible walls and equipped with a cap which can be screwed onto one end of a threaded neck. The neck of this type of tube generally has a small cross-section which is designed to dispense the product over a width substantially corresponding to the width of a tooth brush. Generally, the neck opening is defined perpendicular to a principal lengthwise axis of the tube, and the cap which closes off the tube is removable to allow the product to be taken up.

As a variant, U.S. Pat. No. 2,729,361 describes a tube of this kind with flexible walls in which the single dispensing aperture is not formed at a neck aperture defined perpendicular to the principal lengthwise axis of the tube. Instead, the aperture is formed at the level of a screw thread on the neck so that the cap, in this case in the form of a nut, engages with the thread to travel along the threaded neck and thereby selectively determine the manner in which the product is dispensed. When the nut is positioned around the screw thread in which the aperture is formed, this aperture is then closed off.

Where the dispensing aperture is formed in a screw thread on the neck of a conventional toothpaste tube, as taught by U.S. Pat. Nos. 2,729,361 and 2,721,004, the opening defined perpendicular to the principal lengthwise axis of the tube is closed off by a cap so that it does not define a dispensing aperture. This opening is generally of the same cross-section as the lateral dispensing aperture. The leaktight cap is mounted so that it cannot be removed from the tube, even when the user presses on the walls of the tube to expel product via the single dispensing aperture exposed by the nut.

SUMMARY OF THE INVENTION

One of the objects of the invention is to provide a pot designed for easy dispensing of the contents which wholly or partially resolves the problems discussed above with reference to known devices. In a preferred example, the dispensing action can be accomplished from two separate apertures.

With the pot incorporating two separate dispensing apertures according to the present invention, the user is able to choose between two separate methods of take-up or removal of the product from the container, preferably at any time during the useful life of the pot, depending on which of the two methods is best suited to the user's needs. The user is also able to avoid having to clean her fingers between each application of different products, thus avoiding or at least reducing the possibility of contamination of the product contained in the pot. In addition, the pot can be made economically in that a single lid serves to selectively close off the two dispensing apertures. Selective opening of the apertures is, in a preferred example, accomplished by moving the lid along the neck of the pot in question, with this movement ultimately aiming to completely detach the lid from the neck.

Another object of the invention is to provide a pot of this kind that is economical to make and simple to use.

A further object of the invention is to provide a pot in which the action of taking up the product using a finger is preserved, and which also allows the product to be taken up at an outlet of a dispensing aperture without having to insert one's finger or fingers into the pot.

A still further object of the invention is to create a pot having two dispensing apertures have distinctly dissimilar cross-sections.

Further objects of the invention will become apparent from the detailed description which follows.

According to the invention, these objects are achieved, wholly or partially, by providing a packaging and dispensing device for a product, such as a cosmetic and/or beauty care product, which includes a container for holding the product. The container is surmounted by a neck, such that a free edge of the neck delineates a first dispensing aperture for the product. A detachable lid is capable of engaging with the neck to selectively close off this first dispensing aperture. In addition, the free edge of the neck at least partially delineates a second dispensing aperture, with the second dispensing aperture being capable of passing from a closed off position to an open position in response to a movement of the lid relative to the neck. This arrangement can allow the product to be dispensed in different dispensing modes as described below.

i) In a first dispensing mode, the lid is in an intermediate position relative to the neck, with the intermediate position between a closed position of the first aperture and a detached position from the neck, and the product is dispensed via the second aperture.

ii) In a second dispensing mode, the lid is detached from the neck, and the product is dispensed via the first aperture.

The term neck is to be understood to mean part of a container presenting a narrower cross-section relative to the other sections of the container.

Advantageously, the first aperture can define a cross-section capable of allowing product to be taken up from the inside of the pot. For example, the first aperture can have a size capable of allowing manual take-up of the product directly from inside the container.

In another advantageous feature, the second aperture can define an opening having a cross-section capable of allowing product to be taken up from outside the pot. For example, the second aperture can have a size capable of preventing manual take-up of the product directly from inside the container.

Preferably, the maximum opening of the second aperture is smaller than the maximum opening presented by the first aperture.

In the first dispensing mode, according to a preferred mode of use of the device according to the invention, the opening presented by the second aperture is in part delineated by a flange of the lid. Thus, depending on the position of the lid relative to the container, the opening presented by this second aperture can vary.

In an illustrated example, the first aperture is delineated by the free edge of a neck. Advantageously, the second dispensing aperture is formed within (or through) the thickness of the neck. In this case, the second aperture can form a slot on or along at least part of the height of the neck. This slot emerges at a plane in which the first aperture is principally defined, with the free edge including a portion forming an indentation relative to this plane, such that this portion includes second edges to define the slot. The free edge extends in an annular manner over a non-planar surface. Thus the opening of the second aperture can be defined both by second edges (defining the slot) of the free edge and part of the flange of the lid facing the slot, in particular when the lid is in the intermediate position.

The slot can be easily formed, for example, by molding during manufacture of the device, which is also preferably formed by molding a thermoplastic material.

By way of example, in the case where the neck of the container is defined on a principal lengthwise axis, provision is made to orient the apertures in mutually intersecting planes in order to make it possible to provide the two distinct product dispensing modes referred to above. Thus, depending on the manner in which the user presents the pot, the product is able to emerge by gravity via one or other of the dispensing apertures. In a preferred embodiment, the first aperture is defined perpendicular to this principal lengthwise axis of the neck, while the second aperture is defined parallel to this axis.

In a preferred embodiment, the slot delineated by the second edges forms a trapezoidal cross-section, such that a base of the trapezoid is formed at the free edge, with the height of the trapezoid relative to this base being defined parallel to a principal lengthwise axis of the neck.

In further variants, the shape of the slot may be triangular, square, rectangular, polygonal, round or oval, or any other shape designed to facilitate dispensing, for example when the product is in paste form. The slot can also be in the form of a bead not necessarily of circular cross-section, and capable of providing an advantageous shape for dispensing the product.

Advantageously, the neck can be threaded and the lid can include a counterpart screw thread designed to hold it on the neck. For example, the screw thread can be presented on the inner circumference of a cylindrical portion of the lid, with this cylindrical portion being closed at one end by a bottom. With this example, when the lid is in the closed position on the container, the bottom is capable of ensuring the leaktightness of the first aperture, while the leaktightness of the second aperture is ensured by cooperation between the screw thread on the lid and the lower screw thread on the neck, with the second aperture being located at a level on the neck, on the principal lengthwise axis, above this lower screw thread.

Depending on the position of the lid on the neck, the size of the opening formed at the second aperture can vary. Depending on the number of turns imparted to the lid relative to the neck, the lid moves in a helical fashion such that it rises axially along the neck to progressively expose the outer circumference of the neck. The opening presented by the second aperture is therefore progressively exposed as the lid rises along the neck. Where it is desired to cause the product to emerge from the container via this aperture, the device is preferably oriented so that the product is able to leave by the aperture, for example, by gravity and/or other means.

Preferably, the thread on the neck includes at least one hold point enabling the lid to be maintained in an intermediate position between a first position screwed fully home onto the neck and a second position disengaged from the neck. Preferably, in the intermediate position, the lid at least partially exposes the second aperture so as to allow the product to be dispensed according to the first dispensing mode.

The maximum screwed home position corresponds to a position of the lid in which the bottom of the lid bears, for example, in a leaktight manner against the free edge delineating the first aperture. Furthermore, in order to obtain leaktight closure of the second aperture, in this closed position, the screw thread preferably includes at least one turn engaging with the bottom thread presented by the screw thread on the neck.

In the disengaged position from the neck, the lid is no longer in contact with the neck. Nevertheless, optionally in accordance with the present invention, the lid can be connected to the container by a connecting means in the disengaged position (e.g., with a teather).

Advantageously, the container can include at least one elastically deformable wall such that when pressure is exerted on the wall the product is displaced within the container towards at least one of the dispensing apertures, depending on the position of the lid relative to the neck. Thus, as the level of product inside the pot diminishes, the presence of a deformable wall of this kind makes it possible to bring the product into proximity with the first and/or second aperture of the pot, thereby allowing the product to be readily taken up with the finger.

Preferably, when the lid is only partially unscrewed relative to the neck, and only the opening of the second aperture is at least partially accessible, the container is oriented upside down, with the second aperture facing downward, and pressure is then exerted on the side walls, thus recovering the product which flows downward by gravity and the excess pressure created in the container. Thus, as the level of product inside the pot diminishes, the presence of the deformable wall makes it possible to bring the product into proximity with the second aperture, thereby allowing it to be readily taken up with the finger.

Preferably also, the deformable wall of the container is capable of reverting resiliently to a non-deformed position when the pressure is relaxed.

Alternatively, the container can then be placed on a horizontal surface and, in the second dispensing mode, the lid can be removed completely and the product then taken up directly from the container. In particular, the user can scrape the inside walls of the container in order to take up the residual product.

The device according to the invention can be used advantageously for the packaging of a cosmetic product, for example, a hairstyling product, or a skincare or haircare product.

A further object of the invention is to provide a process for use of a packaging and dispensing device according to the invention. In accordance with the preferred process, the user can choose to take up the product either:

i) according to a first dispensing mode, via the second aperture, with the lid being placed in an intermediate position relative to the neck, or
ii) according to a second dispensing mode, via the first aperture, with the lid being detached from the neck.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
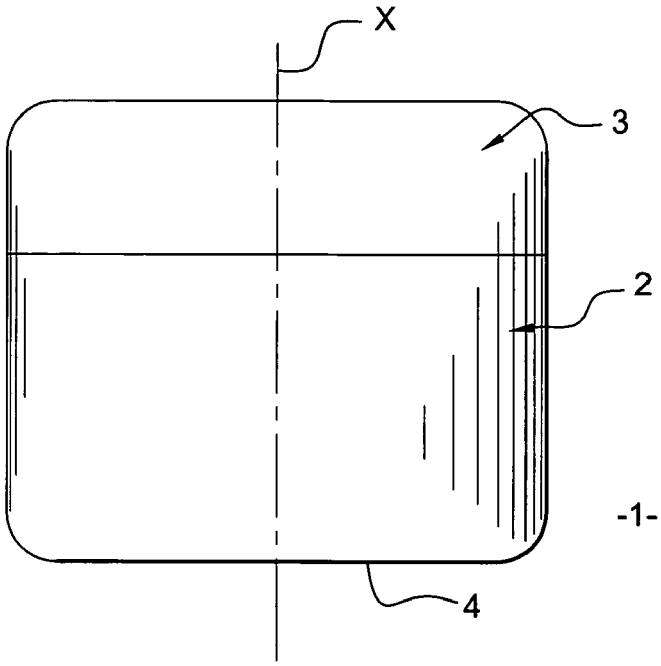
FIG. 1 is a profile view of a device according to the invention in the closed position.

FIG. 1 shows a device 1 according to an example of the invention. The device 1 includes a container 2 and a lid 3. The container 2 is of circular cross-section, for example, and preferably of cylindrical shape. The container 2 includes a bottom 4 on which the container can be placed in a stable position on a flat and horizontal surface. This bottom 4 is preferably defined in a plane perpendicular to a lengthwise axis X, corresponding for example to an axis of symmetry about at least one part of the container 2. The bottom 4 also has a circular cross-section for example. Preferably, the container has a height relative to the lengthwise axis X smaller than the diameter of a cross-section of the container, with this cross-section being defined in a plane perpendicular to this lengthwise axis X.

Figure 2:
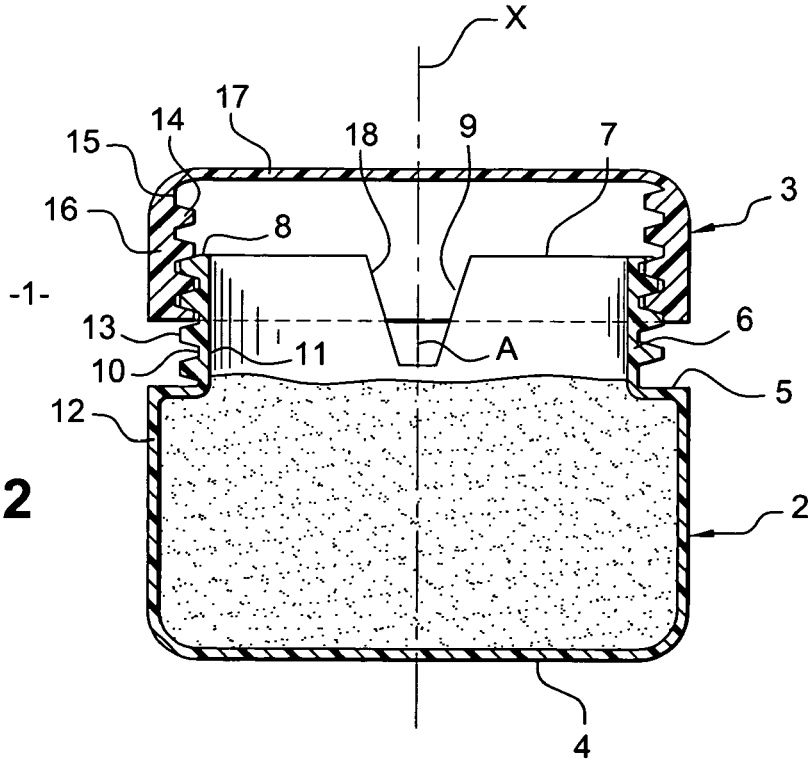
FIG. 2 is a transverse sectional view of a device according to the invention in an intermediate position.

As illustrated in FIG. 2, the container 2 includes a shoulder 5. The shoulder is surmounted by a neck 6 delineating a first aperture 7. The shoulder 5 and the neck 6 respectively present smaller inside diameters than the inside diameter of the container 2. Preferably, the container 2 is filled so that the maximum level of product placed therein is below the neck 6, and more preferably at the level of the shoulder 5. The lengthwise axis X defines a principal lengthwise axis of the neck 6. The first aperture 7 is delineated by a first free edge 8 of the neck 6. The free edge 8 is preferably defined in a plane orthogonal to the lengthwise axis X.

The device 1 includes a second aperture 9 formed within or extending through the thickness of the wall constituting the neck 6. The second aperture 9 creates a slot communicating between an outer circumference 10 of the neck 6 and an inner circumference 11 of this neck 6.

When the lid 3 is mounted on the container 2 in the closed position, see FIG. 1, neither of the two apertures 7 and 9 is visible or exposed. The two dispensing apertures 7 and 9 of the device are closed off preferably in a leaktight manner by the lid 3. Dispensing of product is then prevented. On the other hand, when the lid 3 is moved relative to the neck 6, at a height corresponding to an intermediate position along the axis X, between the closed position and a position fully detached from the neck 6, then at least one section A of the opening presented by the second aperture 9 is visible or exposed. When the container 2 is resting on its bottom 4, the product does not flow out of the container via this second aperture 9, by virtue of the fact that the container 2 is preferably filled to its maximum level up to the junction between the neck 6 and the remainder of the container 2.

To cause the product to emerge, when the lid 3 is in this intermediate position, the user grasps the container 2 and orients the second aperture 9 downward. In the case where the product has a relatively paste-like consistency and does not readily flow by gravity alone, the container 2 is preferably provided with at least one elastically deformable wall. For example a sidewall 12 of the container 2 parallel to the axis X, and/or the bottom 4, are elastically deformable. The side wall 12 is defined below the shoulder 5.

The deformable wall can be made of an elastomeric material, or a polyolefin obtained by metallocene catalysis.

More specifically, examples of such materials include a material (metallocene polyethylene) marketed under the trademark Exact™ by DSM, or a material (metallocene polypropylene) marketed under the trademark Metocene™ by TARGOR.

The lid 3 and the container 2 are preferably designed to be capable of maintaining this intermediate position, so that the pressure exerted on the deformable wall in order to expel the product does not cause the lid 3 to move along the neck 6.

Figure 3:
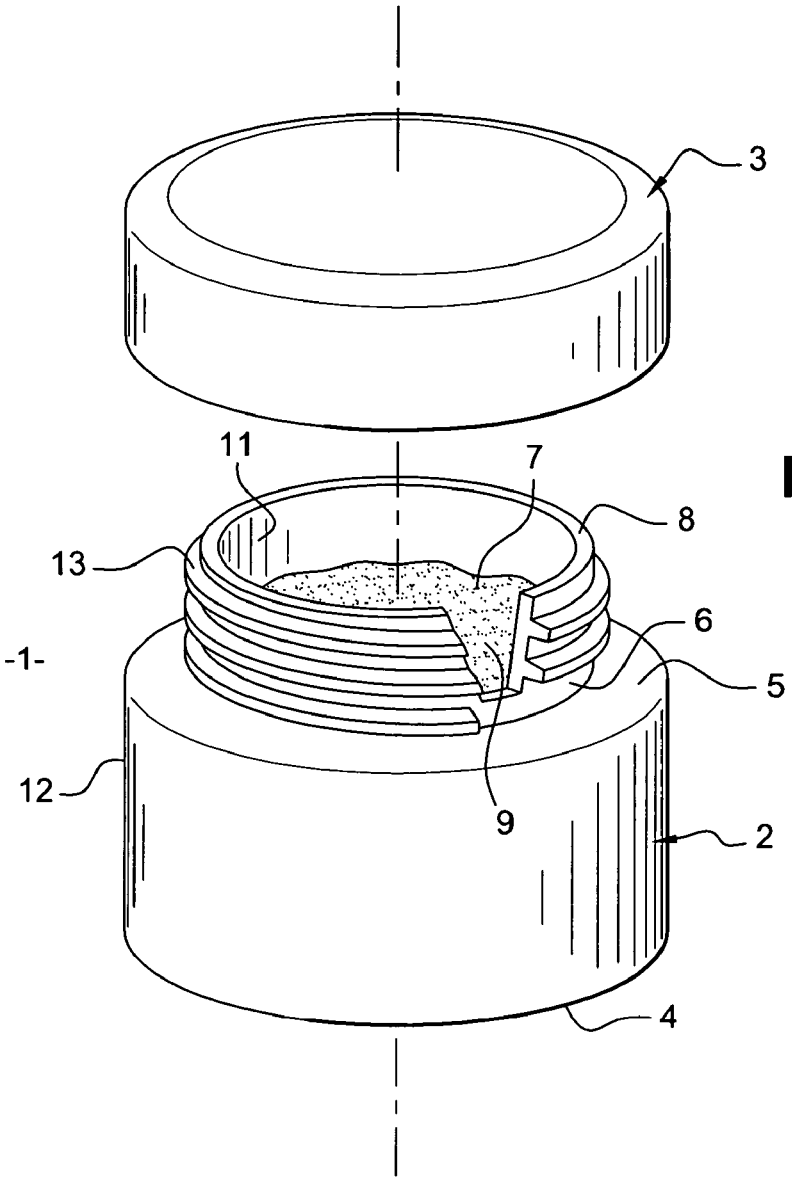
FIG. 3 is a perspective view of a device according to the invention in the open position.
Figure 4:
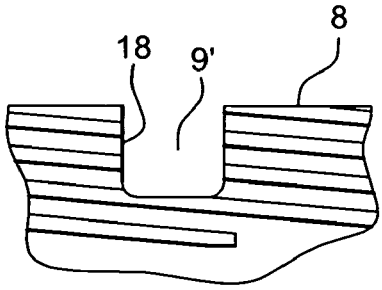
FIG. 4 is a profile view of part of the neck of a device according to the invention.

In a first embodiment, illustrated in FIGS. 2, 3 and 4, the neck 6 incorporates a screw thread 13 on its outer circumference 10 designed to engage with a thread 14 presented on the inner circumference 15 of the lid 3. The lid 3 preferably includes a cylindrical part 16 integral with a closed end 17 intended to bear against the free edges 8 of the neck 6, while the inner circumference 15, at which the screw thread 14 is defined, is presented at the level of the cylindrical part 16 to extend along the cylindrical part 16. In this case, the lid 3 can be maintained in the intermediate position by means of a hold point obtained during engagement of the respective threads 13 and 14.

In a second embodiment, not shown, the neck 6 includes two grooves superimposed one above the other relative to the axis X. In counterpart, the inner circumference 15 incorporates a protuberance designed to selectively engage with the first or second groove. As a variant, the neck can include a single groove designed to engage with various protuberances presented on the inner circumference 15 of the lid 3, with the protuberances being superimposed one above the other relative to the axis X. Cooperation between the lid 3 and the neck 6 in these variations can then take place by means of different levels of snap-on attachment. As a result, the lid can be snapped in place in one or more positions including a closed position in which the apertures 7 and 9 are closed and/or one or more intermediate positions in which the aperture 9 along the neck is at least partially open. Thus, the lid can be snapped in place in a closed position or at one or more intermediate positions for one or more degrees of opening of the second aperture 9.

The lid 3 is detachable, and when it is completely removed from the neck 6, the two dispensing apertures 7 and 9 become accessible. More particularly, the first aperture 7 is accessible for the take-up of product, while the second aperture no longer presents a finite or enclosed separate section because the flange of the lid which participates in defining this opening is detached from the neck 6. Preferably, the user then allows the container 2 to rest on its bottom 4 and makes use of the first dispensing aperture 7, which is of a size suitable for the insertion of at least one finger directly inside the container 2. When little product remains in the container, the user wishing to take up the product with her finger directly from the far corners of the container can exert pressure on the deformable wall so as to bring this wall and the product coating it into proximity with the first dispensing aperture 7. Accordingly, the arrangement facilitates removal of product residues that can remain on the internal surfaces of the side wall 12 or the shoulder 5.

The second dispensing aperture 9 need not be used when the lid 3 is completely detached from the neck 6. The shape of the slot presented by this second aperture 9 can also serve as a means of removing excess product taken up on the fingers from the first aperture 7. As a variant, where the product held in the container 2 is highly fluid, the slot forming the second aperture can serve as a pourer to facilitate the flow of product out of the container 2.

In effect, in a first example of an embodiment of this second aperture 9, illustrated in FIGS. 2, 3 and 4, the second aperture emerges at the free edge 8 of the neck 6. The aperture 9 effectively defines a slot of which the edges 18 descend from the plane in which the free edge 8 is principally defined, with the aperture extending into or through the wall thickness of the neck 6, so as to form a slot extending parallel to the axis X. By way of example, as shown in FIGS. 2 and 3, the slot forms a trapezoid of which the height is oriented parallel to the axis X. Alternatively, as a further example shown in FIG. 4, the second aperture 9 (cut within the thickness of the neck 6 from the free edge 8), the second aperture 9' can present a rectangular slot. As shown in the drawings, preferably a bottom of the slot or second aperture is spaced from the bottom of the neck or above the shoulder. In addition, preferably at a portion of the fastening or coupling arrangement of the lid and/or neck (a screw thread in the illustrated arrangements) extends to a level below the bottom of the slot when the lid is in the closed position. These features can be advantageous in providing a better closure with respect to the second aperture.

The second aperture 9 or 9' is formed along the axis X, such that the opening created by this aperture for the dispensing of product is dependent on the position of the lid 3 along the neck 6, while the first aperture 7 is only accessible when the lid 3 is completely detached from the neck 6. For example, the further the lid 3 rises along the neck 6, the larger the cross-section of the opening formed by the second aperture 9. Preferably the size of the opening presented by this second aperture 9 increases in linear fashion as a function of the upward movement of the lid 3 along the neck 6. Alternatively, the second aperture may be provided as a succession of openings defined separately with respect to each other through the thickness of the neck 6 along the neck 6.

As used herein, expressions such as including one, comprising, having or has should be regarded as synonymous with "including at least one", unless otherwise specified.

Obviously, numerous modifications and variations of the present invention are possible in light of the above teachings. It is therefore to be understood that, within the scope of the appended claims, the invention may be practiced otherwise than as specifically described herein.

The invention claimed is:

1. A device for packaging and dispensing a product, including:

a container holding the product, the container including a neck, wherein the neck includes a free edge which delineates a first dispensing aperture for the product;

a detachable lid capable of engaging with the neck to selectively close off the first dispensing aperture, wherein the detachable lid can be moved from a closed position to a detached position in which the lid is detached from the neck such that the first dispensing aperture is open in the detached position, and further wherein the lid can be positioned in at least one intermediate position between the closed position and the detached position;

wherein the free edge of the neck at least partially delineates a second dispensing aperture, and wherein in said closed position said detachable lid closes said second dispensing aperture, and further wherein movement of the lid relative to the neck from the closed position at least partially opens said second dispensing aperture such that:

i) in a first dispensing mode, with the lid in the at least one intermediate position relative to the neck, the product can be dispensed via the second dispensing aperture, and ii) in a second dispensing mode, with the lid in the detached position, the product can be dispensed via the first dispensing aperture.

2. A device according to claim 1, wherein the first dispensing aperture has a size capable of allowing manual take-up of the product directly from inside the container.

3. A device according to claim 2, wherein the second dispensing aperture defines an opening having a cross-section capable of allowing the product to be taken up from outside the container.

4. A device according to claim 3, wherein the second dispensing aperture has a size capable of preventing manual take-up of the product directly from inside the container.

5. A device according to claim 4, wherein a maximum opening of the second dispensing aperture is smaller than a maximum opening presented by the first dispensing aperture.

6. A device according to claim 5, wherein the second dispensing aperture extends through a thickness of a wall of the neck and forms a slot along at least part of a height of said neck.

7. A device according to claim 1, wherein the second dispensing aperture defines an opening having a cross-section capable of allowing the product to be taken up from outside the container.

8. A device according to claim 1, wherein the second dispensing aperture has a size capable of preventing manual take-up of the product directly from inside the container.

9. A device according to claim 1, wherein a maximum opening of the second dispensing aperture is smaller than a maximum opening presented by the first dispensing aperture.

10. A device according to claim 1, wherein the second dispensing aperture extends through a thickness of a wall of the neck, and forms a slot along at least part of a height of said neck.

11. A device according to claim 1, wherein an opening presented by the second dispensing aperture, in the first dispensing mode, is partially delineated by a flange of the lid.

12. A device according to claim 1, wherein a size of an opening of the second dispensing aperture varies in relation to a position of the lid relative to the container.

13. A device according to claim 12, wherein the second dispensing aperture includes a slot having a trapezoidal cross-section, such that a base of the trapezoid is formed at the free edge, wherein a height of the trapezoid relative to the base is defined parallel to a principal lengthwise axis of the neck.

14. A device according to claim 1, wherein the second dispensing aperture includes a slot having a trapezoidal cross-section, such that a base of the trapezoid is formed at the free edge, wherein a height of the trapezoid relative to the base is defined parallel to a principal lengthwise axis of the neck.

15. A device according to claim 1, wherein the first dispensing aperture is defined perpendicular to a principal lengthwise axis of the neck.

16. A device according to claim 15, wherein the second dispensing aperture is defined parallel to a principal lengthwise axis of the neck.

17. A device according to claim 1, wherein the second dispensing aperture is defined parallel to a principal lengthwise axis of the neck.

18. A device according to claim 1, wherein the neck is threaded and the lid includes a counterpart screw thread, and wherein varying the position of the lid on the neck causes the size of an opening of the second dispensing aperture to vary as a function of the level at which the lid is screwed onto the neck.

19. A device according to claim 18, wherein the thread on the neck includes at least one hold point enabling the lid to be maintained in the intermediate position between a fully screwed home position on the neck and the detached position.

20. A device according to claim 1, wherein the container includes at least one elastically deformable wall such that when pressure is exerted on the at least one elastically deformable wall the product is displaced within the container towards at least one of the first and second dispensing apertures.

21. A device according to claim 20, wherein the at least one elastically deformable wall is capable of reverting resiliently to a non-deformed position when said pressure is relaxed.

22. A device according to claim 1, wherein the container contains a cosmetic product.

23. A device according to claim 22, wherein the cosmetic product is a hairstyling product.

24. A device according to claim 22, wherein the cosmetic product is a skincare product.

25. A device according to claim 22, wherein the cosmetic product is a haircare product.

26. A device according to claim 1, wherein said container includes a container body having a diameter larger than a diameter of said neck.

27. A device according to claim 26, wherein in said intermediate position said lid is axially displaced from said closed position along the neck of the container.

28. A device according to claim 27, wherein said neck and said lid include a cooperating screw arrangement such that rotational movement of said lid relative to said container causes axial displacement of said lid along said neck.

29. A device according to claim 28, wherein at least a portion of said container is flexible such that flexing of said portion facilitates removal of product from said container.

30. A device according to claim 29, further including a cosmetic product disposed in said container.

31. A device according to claim 30, wherein said cosmetic product is a cream.

32. A device according to claim 30, wherein said cosmetic product is a gel.

33. A device according to claim 30, wherein said lid includes a circular free edge.

34. A device according to claim 33, wherein a bottom of said second dispensing aperture is spaced from a bottom of said neck.

35. A device according to claim 26, wherein said neck and said lid include a coupling arrangement to couple said lid to said neck.

36. A device according to claim 35, wherein a portion of said coupling arrangement is disposed at a level below the bottom of the second dispensing aperture at least when the lid is in the closed position.

37. A device according to claim 36, wherein the coupling arrangement includes at least one screw thread.

38. A device according to claim 36, wherein the coupling arrangement includes a screw thread provided on the neck, and wherein a portion of the screw thread on the neck extends beneath the bottom of the second dispensing aperture.

39. A device according to claim 38, wherein movement of the lid axially with respect to the neck varies a size of an opening provided by the second dispensing aperture.

40. A device according to claim 1, wherein the lid is movable to varying axial positions along the neck, and wherein movement of the lid axially along the neck varies a size of an opening of said second dispensing aperture.

41. A device according to claim 40, wherein said opening is partially defined by said second dispensing aperture and wherein said opening is also partially defined by a free edge of said lid.

42. A device according to claim 41, wherein a screw thread is provided on at least one of said lid and said neck, and wherein rotational movement of said lid relative to said neck causes said lid to move axially along said neck.

43. A device according to claim 42, wherein said lid has a circular free edge.

44. A device according to claim 1, wherein said lid has a circular free edge, and wherein said second dispensing aperture and a portion of said circular free edge of said lid define an opening when said lid is in the intermediate position.

45. A device according to claim 44, wherein a size of said opening varies as an axial position of said lid with respect to said neck is varied.

46. A device according to claim 1, wherein said neck and said lid include a coupling arrangement to couple said lid to said neck.

47. A device according to claim 46, wherein a portion of said coupling arrangement is disposed at a level below a bottom of the second dispensing aperture at least when the lid is in the closed position.

48. A device according to claim 47, wherein the coupling arrangement includes at least one screw thread.

49. A process for packaging and dispensing a product, including:

providing a container holding the product, the container including a neck, wherein the neck includes a free edge which delineates a first dispensing aperture for the product;

providing a detachable lid capable of engaging with the neck to selectively close off the first dispensing aperture, wherein the detachable lid can be moved from a closed position to a detached position in which the lid is detached from the neck such that the first dispensing aperture is open in the detached position, and further wherein the lid can be positioned in at least one intermediate position between the closed position and the detached position;

wherein the free edge of the neck at least partially delineates a second dispensing aperture and wherein in said closed position said detachable lid closes said second dispensing aperture, and further wherein movement of the lid relative to the neck from the closed position at least partially opens said second dispensing aperture;

the process further including selectively dispensing the product in a first dispensing mode and a second dispensing mode, wherein:

i) in the first dispensing mode, with the lid in the at least one intermediate position relative to the neck, the product is dispensed via the second dispensing aperture, and ii) in the second dispensing mode, with the lid in the detached position, the product is dispensed via the first dispensing aperture.

50. A process according to claim 49, wherein the first dispensing aperture has a size capable of allowing manual take-up of the product directly from inside the container.

51. A process according to claim 50, wherein the second dispensing aperture defines an opening having a cross-section capable of allowing the product to be taken up from outside the container.

52. A process according to claim 51, wherein the second dispensing aperture has a size capable of preventing manual take-up of the product directly from inside the container.

53. A process according to claim 52, wherein a maximum opening of the second dispensing aperture is smaller than a maximum opening presented by the first dispensing aperture.

54. A process according to claim 53, wherein the second dispensing aperture extends through a thickness of a wall of the neck, and forms a slot along at least part of a height of said neck.

55. A process according to claim 49, wherein a size of an opening of the second dispensing aperture varies in relation to a position of the lid relative to the container.

56. A process according to claim 55, wherein the second dispensing aperture includes a slot having a trapezoidal cross-section, such that a base of the trapezoid is formed at the free edge, wherein a height of the trapezoid relative to the base is defined parallel to a principal lengthwise axis of the neck.

57. A process according to claim 49, wherein the neck is threaded and the lid includes a counterpart screw thread, and wherein varying the position of the lid on the neck causes the size of an opening formed by the second dispensing aperture to vary as a function of the level at which the lid is screwed onto the neck.

58. A process according to claim 49, wherein the container includes at least one elastically deformable wall such that when pressure is exerted on the at least one elastically deformable wall the product is displaced within the container towards at least one of the first and second dispensing apertures.

59. A process according to claim 49, wherein said neck and said lid include a coupling arrangement to couple said lid to said neck.

60. A process according to claim 59, wherein a portion of said coupling arrangement is disposed at a level below a bottom of the second dispensing aperture at least when the lid is in the closed position.

61. A process according to claim 60, wherein the coupling arrangement includes at least one screw thread.

62. A device according to claim 1, wherein the second dispensing aperture is disposed on the neck and extends up to a top of the neck such that, at the top of the neck, the first dispensing aperture is in communication with the second dispensing aperture.

63. A device according to claim 1, wherein the second dispensing aperture can be exposed only between a bottom edge of the lid and a bottom of the neck.

64. A device according to claim 1, wherein the detachable lid includes a continuously closed sidewall without an aperture extending therethrough.

65. A process according to claim 49, wherein the second dispensing aperture is disposed on the neck and extends up to a top of the neck such that, at the top of the neck, the first dispensing aperture is in communication with the second dispensing aperture.

66. A process according to claim 49, wherein, in the first dispensing mode, the second dispensing aperture can be exposed only between a bottom edge of the lid and a bottom of the neck.

67. A process according to claim 49, wherein the providing a detachable lid includes providing the detachable lid with a continuously closed sidewall without an aperture extending therethrough.

* * * * *